United States Patent [19]

Miller

[11] Patent Number: 4,795,546

[45] Date of Patent: Jan. 3, 1989

[54] PROCESS FOR STABILIZING LUBE BASE STOCKS DERIVED FROM NEUTRAL OILS

[75] Inventor: Stephen J. Miller, San Francisco, Calif.

[73] Assignee: Chevron Research Company, San Francisco, Calif.

[21] Appl. No.: 78,614

[22] Filed: Jul. 28, 1987

Related U.S. Application Data

[63] Continuation-in-part of Ser. No. 782,260, Sep. 30, 1985, abandoned.

[51] Int. Cl.[4] ..... C10G 67/00

[52] U.S. Cl. ..... 208/97; 208/18; 208/58; 208/67; 208/98; 208/111; 585/733; 585/739

[58] Field of Search ..... 208/18, 111, 58, 67, 208/97, 98; 585/733, 739

[56] References Cited

U.S. PATENT DOCUMENTS

| | | | |
|---|---|---|---|
| 3,671,423 | 6/1972 | MacDonald et al. | 208/97 |
| 3,880,747 | 4/1975 | Mills et al. | 208/18 |
| 3,894,938 | 7/1975 | Gorring et al. | 208/111 |
| 3,928,171 | 12/1975 | Yan et al. | 208/46 |
| 4,176,050 | 11/1979 | Chen et al. | 208/18 |
| 4,181,597 | 1/1980 | Yan et al. | 208/58 |
| 4,347,121 | 8/1982 | Mayer et al. | 208/58 |
| 4,361,477 | 11/1982 | Miller | 208/58 |
| 4,414,097 | 11/1983 | Chester | 208/58 |
| 4,443,327 | 4/1984 | Shihabi et al. | 208/111 |
| 4,549,955 | 10/1985 | Shih | 208/97 |

FOREIGN PATENT DOCUMENTS

| | | | |
|---|---|---|---|
| 0108495 | 6/1985 | Japan | 208/67 |

OTHER PUBLICATIONS

"Catalytic Dewax Process Improved", Oil & Gas Journal 10-27-80, pp. 77-84, (Donnelly et al).

*Primary Examiner*—H. M. S. Sneed
*Assistant Examiner*—Helane Myers
*Attorney, Agent, or Firm*—S. R. La Paglia; T. G. DeJonghe; V. J. Cavalieri

[57] ABSTRACT

A process for improving the storage stability of hydrocracked neutral oil lubricating oil stocks comprising a dewaxing step utilizing a high silica zeolite catalyst to produce a dewaxer effluent and two stabilizing steps utilizing hydrofinishing and nonhydrogenative stabilization by an acidic catalyst.

12 Claims, No Drawings

PROCESS FOR STABILIZING LUBE BASE STOCKS DERIVED FROM NEUTRAL OILS

CROSS-REFERENCE TO RELATED APPLICATION

This is a continuation-in-part of U.S. Ser. No. 782,260, filed Sept. 30, 1985 now abandoned.

BACKGROUND OF THE INVENTION

This invention relates to a process for improving the storage stability of lube oil base stocks derived from a neutral oil. By "storage stability" is meant the resistance of the oil to forming a floc in the presence of oxygen. The process comprises three steps. In the first step a neutral oil stock is catalytically dewaxed to produce a dewaxed stock. In the second step the dewaxed stock is hydrofinished to produce a partially hydrogenated dewaxed stock. In the third step the partially hydrogenated dewaxed stock is stabilized by nonhydrogenative acid stabilization. It has been found that the storage stability of the resultant lube oil base stock is significantly improved.

Refining suitable petroleum crude oils to obtain a variety of lubricating oils which function effectively in diverse environments has become a highly developed and complex art. Although the broad principles involved in refining are qualitatively understood, there are quantitative uncertainties which require considerable resort to empiricism in practical refining. Underlying these quantitative uncertainties is the complexity of the molecular constitution of lubricating oils. Because lubricating oils for the most part are based on petroleum fractions boiling above about 550° F., the molecular weight of the hydrocarbon constituents is high and these constituents display almost all conceivable structures and structure types. This complexity and its consequences are referred to in "Petroleum Refinery Engineering", by W. L. Nelson, McGraw Hill Book Company, Inc., New York, N.Y., 1958 (Fourth Edition), relevant portions of this text being incorporated herein by reference for background.

The basic notion in lubricant refining is that a suitable crude oil, as shown by experience or by assay, contains a quantity of lubricant base stock having a predetermined set of properties such as, for example, appropriate viscosity, oxidation stability, and maintenance of fluidity at low temperatures. The process of refining to isolate that lubricant base stock currently consists of a set of unit operations to remove or convert the unwanted components. The most common of these unit operations include, for instance, hydrocracking, dewaxing, distillation, and hydrofinishing.

The lubricant base stock isolated by these refining operations may be used as such as a lubricant, or it may be blended with another lubricant base stock having somewhat different properties. Or, the base stock, prior to use as a lubricant, may be compounded with one or more additives which function, for example, as antioxidants, extreme pressure additives, and viscosity index improvers. As used herein, the term "stock", regardless whether or not the term is further qualified, refers to a hydrocarbon oil without additives. The term "raw stock" refers to an untreated viscous distillate or the residuum fraction of crude petroleum oil isolated by vacuum distillation of a reduced crude from atmospheric distillation, or its equivalent. The term "dewaxed stock" will refer to an oil which has been treated by any method to remove or otherwise convert the wax contained therein and thereby reduce its pour point. The term "base stock" will refer to an oil refined to a point suitable for some particular end use, such as for preparing automotive oils.

In general, refineries do not manufacture a single lube base stock but rather process at least one distillate fraction and the vacuum residuum. For example, three distillate fractions differing in boiling range and the residuum may be refined. These four fractions have acquired various names in the refining art, the most volatile distillate fraction often being referred to as the "light neutral" fraction or oil. the other distillates are called "medium neutral" and "heavy neutral" oils. The vacuum residuum, after deasphalting, solvent extraction and dewaxing, is commonly referred to as "bright stock". Thus, the manufacture of lubricant base stocks involves a process for producing a slate of base stocks, which slate includes at least one refined distillate.

Processes have been proposed to produce lubricating oils from ordinary and low quality base stocks derived from neutral oils which normally would be converted into other products. Many of these processes use a hydrocracking step. The problem is that such hydrocracked stocks tend to have poor storage stability.

Some process schemes proposed for hydrocracked stocks also involve the use of catalytic dewaxing to lower the pour point of the final lubricant base stock. The product of catalytically dewaxing a hydrocrackate stock tends to be unstable such that further processing is required to make a stable oil.

The typical dewaxed hydrocrackate stock is hydrofinished by a mild hydrogenation process to increase the resistance of the bulk oil toward oxidation. The goal of this process is to hydrogenate those species which readily react with oxygen, while minimizing further cracking and loss of the lubricant base stock. Even though the hydrofinished product has high resistance toward bulk oxidation, its storage stability is often low. It is believed that this is due to the difficulty of totally saturating the floc-forming agents, thought to be partially hydrogenated polycyclic aromatics. These agents, upon reaction with oxygen, can lead to floc formation during storage of the oil.

There are several nonhydrogenation processing techniques recommended in the patent literature as methods to achieve improved lubricant storage stability. Some of the earlier efforts concentrated on the addition of stabilizing agents to a dewaxed hydrocrackate while in the presence of a heterogeneous acidic catalyst. Several issued patents relate to stabilizing hydrocracked lubricant base stocks by adding stabilizing agents such as olefins, alcohols, esters or alkylhalides to the lube stock while in the presence of a heterogeneous acidic catalyst such as acid resins, clays, and aluminosilicates having controlled alkylation activity. For instance, U.S. Pat. No. 3,928,171, Yan et al., Dec. 23, 1975 and U.S. Pat. No. 4,181,597, Yan et al., Jan. 1, 1980 disclose processes for stabilizing hydrocracked lube oils which have been dewaxed, preferably solvent dewaxed, by contacting them with stabilizing agents such as $C_6$ to $C_{10}$ olefins. The stabilizing catalyst is a heterogeneous acidic catalyst; the olefins which are not consumed in the reaction are distilled off from the product and combined with other olefins to be added into the stabilizing reaction zone feed. As discussed in U.S. Pat. No. 4,181,597 the mechanism responsible for the benefits obtained when using a stabilizing agent was not entirely understood.

However, since the stabilizing agent is consumed during the stabilization reaction, it is likely that a reaction occurs between one or more components of the dewaxed lube oil stock and the stabilizing agent. In particular, conditions during the stabilization process are conducive to alkylation. Nonetheless these earlier efforts refrain from asserting that any particular mechanism can be identified as the stabilizing reaction.

Subsequent to the disclosure of the use of a stabilizing agent it was found that if the dewaxing step was carried out using as a catalyst a low aluminum content intermediate pore size zeolite substantially free of hydrogen transfer activity, the resulting dewaxed effluent comprising in situ generated olefins when contacted with an acidic alkylation catalyst produced a low pour point, high stability, low color, lube stock in good yields. U.S. Pat. No. 4,361,477, Nov. 30, 1982, describes a two-step process for dewaxing and stabilizing hydrocracked stocks. The dewaxing step uses a high-silica zeolite catalyst to produce catalytic dewaxer effluent containing lower olefins for favorable stabilizing (alkylation) reactions. The stabilizing step uses an acidic catalyst substantially free of hydrogenation activity to stabilize the dewaxed lube oil. The primary advantage of the two-step process resides in the improved stability of the lube oil product obtained in good yields, without the need to use a stabilizing agent. The mechanism responsible for the stabilizing reaction again appears to be an alkylation reaction between the unstable polycyclic aromatics present in the dewaxer effluent and the olefins also present. This alkylation process has been called nonhydrogenative stabilization.

Thus, at the time of the present invention, the patent literature relating to lube oil stabilization taught nonhydrogenative stabilization (alkylation) as an alternative to hydrofinishing a dewaxed stock. Furthermore, the patent literature taught two approaches to nonhydrogenative stabilization. In one approach, a conventionally dewaxed stock is stabilized when contacted with an externally supplied stabilizing agent in the presence of an acidic catalyst. In a second approach, a hydrocrackate stock is dewaxed under conditions selected to internally generate an olefinic stabilizing agent during dewaxing and then stabilized using an acidic catalyst and the internally supplied stabilizing agent. These two approaches, both apparently relying upon an alkylation reaction, have been employed as alternatives to conventional hydrofinishing, and those familiar with lube oil stabilization have identified the occasions when the advantages of each approach over the other can be better utilized.

In spite of the large amount of research into developing lubricant base stocks and stabilizing them, there continues to be intensive research into developing more efficient and more convenient method for achieving those goals. The object of the present invention is to provide such a more convenient and efficient process.

It has now been discovered that a three-step process comprising a catalytic dewaxing step and a two-step stabilization process in turn comprising a hydrofinishing step and a nonhydrogenative acid stabilization step using an added olefinic stabilizing agent results in improved stability. Thus, rather than employing the nonhydrogenative stabilization step as a substitute for hydrofinishing, the present invention employs it in addition to hydrofinishing when refining a dewaxed hydrocrackate neutral oil.

SUMMARY OF THE INVENTION

The discovery of the present invention is embodied in an improved process for stabilizing a lube base stock derived from a neutral oil hydrocrackate, comprising:

(a) contacting said neutral oil hydrocrackate with a catalyst which comprises an intermediate pore size zeolite, said zeolite being in the hydrogen form, to produce a dewaxed effluent, (b) contacting said dewaxed effluent with hydrogen in the presence of a hydrogenation catalyst under mild hydrogenation conditions to produce a hydrofinished effluent, and (c) contacting said hydrofinished effluent with a heterogeneous acidic catalyst in the presence of a minor amount of an olefinic stabilizing agent.

DETAILED DESCRIPTION

The hydrocarbonaceous feeds from which the neutral oils used in the process of this invention are obtained usually contain aromatic compounds as well as normal and branched paraffins of very long chain lengths. These feeds usually boil in the gas oil range. Preferred feedstocks are vacuum gas oils with normal boiling ranges above about 350° C. and below about 600° C., and deasphalted residual oils having normal boiling ranges above about 480° C. and below about 650° C. Reduced topped crude oils, shale oils, coke distillates, flask or thermally cracked oils, atmospheric residua, and other heavy oils can also be used as the feed source. The process is particularly effective in stabilizing lube oils prepared from the heavy and medium neutral oils as well as being effective in stabiblizing lighter feedstocks, e.g., light neutral oils.

While the process can be practiced with utility when the feed contains organic nitrogen and sulfur, it is preferred that the organic nitrogen and sulfur contents of the feed both be less than 50, more preferably less than 10, ppmw. Organic nitrogen is found to be deleterious to the activity of all three process stages, while organic sulfur is deleterious to the activity of the hydrofinishing step.

Typically, the hydrocarbonaceous feed is distilled at atmospheric pressure to produce a reduced crude (residuum) which is then vacuum distilled to produce a distillate fraction and a resid fraction. According to the present process the distillate fraction comprising neutral oils is then hydrocracked using standard reaction conditions and catalysts in one or more reaction zones and with or without initial denitrogenation or desulfurization steps. The resulting neutral oil hydrocrackate is suitable as the feed stock to the three-step process of this invention.

Typical hydrocracking conditions include temperatures in the range of 250° C. to 500° C., pressures in the range of 30 to 205 bar or more, a hydrogen recycle rate of 100 to 1100 SCM/KL, and an LHSV (v/v/hr) of 0.1 to 50.

Typical hydrocracking catalysts include those having hydrogenation-dehydrogenation activity, and active cracking supports. The support is often a refractory inorganic oxide such as silica-alumina, silica-alumina-zirconia and silica-alumina-titania composites, acid-treated clays, crystalline aluminosilicate zeolitic molecular sieves (such as Zeolite A, faujasite, Zeolite X and Zeolite Y), and combinations of the above.

Hydrogenation-dehydrogenation components of the hydrocracking catalyst usually comprise metals selected from Group VIII and Group VI-B of the Periodic Table, and compounds including them. Preferred Group VIII components include cobalt and nickel and their oxides and sulfides. Preferred Group VI-B components are the oxides and sulfides of molybdenum and tungsten. Thus, examples of hydrocracking catalysts which are preferred to use in the hydrocracking step are the combinations nickel-tungsten-silica-alumina and nickel-molybdenum-silica-alumina.

Nickel sulfide/tungsten sulfide on a silica-alumina base which contains discrete metal phosphate particles (described in U.S. Pat. No. 3,493,517, incorporated herein by reference) is a particularly preferred hydrocracking catalyst.

The distillate fraction, comprising neutral oils, is isolated by conventional distillation from the heavier resid fraction. The distillate fraction or portions of it are used as the feed to the process of the present invention.

In the first step of the present process all or a portion of the distillate fraction is catalytically dewaxed using intermediate pore size zeolites having a silica-to-alumina mole ratio greater than about 30:1 and standard reaction conditions. In spite of their low aluminum content, these zeolites have useful dewaxing activity.

By "intermediate pore size" as used herein is meant an effective pore aperture in the range of about 5 to 6.5 Angstroms when the zeolite is in the H-form. Zeolites having pore apertures in this range tend to have unique molecular sieving characteristics. Unlike small pore zeolites such as erionite, they will allow hydrocarbons having some branching into the zeolitic void spaces. Unlike large pore zeolites such as the faujasites, they can differentiate between n-alkanes and slightly branched alkanes on the one hand and large branched alkanes having, for example, quaternary carbon atoms.

The effective pore size of the zeolites can be measured using standard adsorption techniques and hydrocarbonaceous compounds of known minimum kinetic diameters. See Breck, *Zeolite Molecular Sieves*, 1974 (especially Chapter 8) and Anderson et al., J. Catalysis 58, 114 (1979), both of which are incorporated by reference.

Intermediate pore size zeolites in the H-form will typically admit molecules having kinetic diameters of 5.0 to 6.5 Angstroms with little hindrance. Examples of such compounds (and their kinetic diameters in Angstroms) are: n-hexane (4.3), 3-methylpentane (5.5), benzene (5.85), and toluene (5.8). Compounds having kinetic diameters of about 6 to 6.5 Angstroms can be admitted into the pores, depending on the particular zeolite, but do not penetrate as quickly and in some cases are effectively excluded (for example, 2,2-dimethylbutane is excluded from HZSM-5). Compounds having kinetic diameters in the range of 6 to 6.5 Angstroms include: cyclohexane (6.0), 2,3-dimethylbutane (6.1), 2,2-dimethylbutane (6.2), and m-xylene (6.1). Generally, compounds having kinetic diameters of greater than about 6.5 Angstroms do not penetrate the pore apertures and thus are not adsorbed into the interior of the zeolite. Examples of such larger compounds include: o-xylene (6.8), 1,3,5-trimethylbenzene (7.5), and tributylamine (8.1).

The preferred effective active pore size range is from about 5.3 to about 6.2 Angstroms, ZSM-5 and silicalite, for example, fall within this range.

In performing adsorption measurements to determine pore size, standard techniques are used. It is convenient to consider a particular molecule as excluded if it does not reach at least 95% of its equilibrium adsorption value on the zeolite in less than about 10 minutes (p/po=0.5; 25° C.).

Examples of intermediate pore size zeolites include, silicalite, and members of the ZSM series such as ZSM-5, ZSM-11, ZSM-12, ZSM-21, ZSM-23, ZSM-35, and ZSM-38.

Silicalite is described in U.S. Pat. No. 4,061,724; crystalline organosilicates are described in U.S. Pat. No. RE 29,948 of U.S. Pat. No. 3,941,871, Dwyer et al., Mar. 2, 1976; ZSM-5 is described in U.S. Pat. Nos. 3,702,886 and 3,770,614; ZSM-11 is described in U.S. Pat. No. 3,709,979; ZSM-12 is described in U.S. Pat. No. 3,832,449; ZSM-21 and ZSM-38 are described in U.S. Pat. No. 3,948,758; ZSM-23 is described in U.S. Pat. No. 4,076,842; and ZSM-35 is described in U.S. Pat. No. 4,016,245. These patents are incorporated herein by reference. The preferred zeolites are ZSM-5 and silicalite.

Typical dewaxing conditions include an LHSV (v/v/hr) of 0.5 to 30, a temperature from about 260° C. to 450° C. and a pressure from below atmospheric to several hundred bar. Where the feed to the dewaxing step has a wide boiling range, it is especially preferred to separate it into at least two fractions, where each fraction has a boiling range of greater than about 50° C. When a wide boiling range feed is catalytically dewaxed, the higher boiling portions tend to be underwaxed while the lower boiling portions tend to be overdewaxed. By splitting the feed to the dewaxing step, the different boiling range fractions can be dewaxed at different severities. After dewaxing, the separate streams can be recombined or processed separately.

The dewaxing step can take place at high or low pressures and the feedstock can contain diluent gases. This flexibility in pressure and gas content allows more efficient refinery operation in that the feedstock which has been hydrocracked, usually at pressures above 135 bar, can be dewaxed at the same pressure.

In the second step of the present process the dewaxed hydrocrackate stock is hydrofinished. Conventional hydrofinishing processes can be employed. Normally, hydrofinishing is performed using a catalyst which contains one or more metals having hydrogenation activity selected from metals belonging to Group VIII of the Periodic Table such as Pd, Pt, Co, Ni, etc., and metals belonging to Group VI of the Periodic Table such as Mo, W, etc. or their oxides or sulfides on alumina, silica-alumina, zeolite, etc. and performed at a temperature of 200°–400° C., a pressure of 50–175 kg/cm$^2$, a LHSV of 0.25–3.0 per hour, and $H_2$/oil; 10–300 Nm$^3$/kl. Thus, in general terms the dewaxed effluent is contacted with hydrogen in the presence of a hydrogenation catalyst under mild hydrogenation conditions. Suitable catalysts and conditions are detailed for instance in U.S. Pat. No. 4,157,294 granted June 5, 1979 to Iwao et al. and U.S. Pat. No. 3,904,513, granted Sept. 9, 1975 to Fischer et al., both incorporated herein by reference.

The hydrofinished dewaxed stock is further stabilized in the final step of the present process by contacting the stock with a minor amount of an olefinic stabilizing agent in the presence of a heterogeneous acidic catalyst.

The heterogeneous acid catalyst used in the final stabilizing step is an acidic, or acid-acting catalyst. The classes of suitable catalysts include acid resins, clays, aluminosilicates, such as zeolites, and other acidic oxides. These solid catalysts which are useful in fluid and fixed bed catalysis, being hetereogeneous to the reactants, are readily separable therefrom.

Of particular interest are the resins, clays and zeolites. The resins, preferably cation exchange resins, consist of a polymeric resin matrix having acidic functional group, such as sulfonic, phosphonic, phenyl sulfonic, phenylphosphonic, phenolsulfonic, and the like. The matrix may be any resin; the resin preferably is porous, or becomes porous during the process. Resins include phenolic resins, polystyrene, copolymers of styrene with polyfunctional polymerizable monomers or partial polymers, such as styrene-divinyl aryls, e.g., divinyl benzene, or acrylates, polyacrylic or polymethacrylic acid resins, and the halogenated variations of these above said resins. Acidic clays, such as attapulgite and montmorillonite are among the preferred catalysts. Crystalline aluminosilicates, at least partially in the hydrogen form, are also very good catalysts. They generally have the formula:

$$M_{2/n}O:Al_2O_3:ySiO_2:zH_2O$$

where M is a cation, n is its valence, y is the moles of silica, and z is the moles of water. Crystalline zeolites are well-known. Modified zeolites, such as rare-earth-exchanged or other metal exchanged zeolites may be used. Rare-earth-exchanged Y-types (y is over 3) and X-types (y is under 3) are examples of these. Both natural alumino-silicates, such as levynite, faujasite, analcite, noselite, phillipsite, datolite, chabazite, leucite, mordenite, and the like, and synthetic aluminosilicates are examples of satisfactory catalysts. Other catalysts which may be used in this invention include inorganic oxides such as alumina, silica-alumina, thoria, zirconia, silica-zirconia, silica-magnesia, titania, germania, ceria, halogenated alumina, and mixtures thereof and these with any of the other foregoing classes of catalysts.

Those skilled in the art of heterogeneous catalysis recognize that there are many insoluble solids with a porous structure that are effective in inducing acid-catalyzed reactions, and that, because of this property, are referred to as "acidic". It is also recognized that these heterogeneous, acidic catalysts vary in efficacy, depending on catalyst preparations in some cases, and on other factors such as the particular reactions involved. These heterogeneous acidic catalysts may be organic, such as sulfonated polystyrene, or inorganic, such as silica-alumina cracking catalysts. The inorganic acidic catalysts exemplified in the foregoing paragraphs and elsewhere are simple or mixed inorganic oxides, which may be polymeric or hydrated to varying extents, as will be recognized by one skilled in the art. With few exceptions, the heterogeneous inorganic acidic oxide catalysts useful in this invention comprise an oxide selected from the group consisting of silicon and aluminum. Included in this group are the acidic clays, the acidic forms of crystalline aluminosilicate zeolites, and the known acidic cracking catalysts based on mixed oxides such as silica-alumina, silica-magnesia and silica-zirconia.

The dewaxed hydrofinished effluent, or at least part of it, is mixed with the catalyst and a minor amount of an olefinic stabilizing agent, typically in a continuous operation, for example, in a fixed bed reactor which contains the catalyst. Catalyst contact may be carried out at between about 20° C. to 400° C., preferably from 25° C. and 350√]C., and most preferably from 90° C. to 280° C. The stabilizing step may be carried out batchwise or continuously at a temperature of about 20° C. to about 400° C., an LHSV of about 0.1 to about 10 (when carried out continuously) and any convenient pressure. The preferred ranges for the above conditions are temperature of 90° C. to about 280° C., an oil LHSV of 0.2 to 2, and pressure of from about 1 to about 35 bar (gauge).

The olefinic stabilizing agents employed in the final stabilization step are from either or both of two sources. First, the effluent of the catalytic dewaxing step may contain suitable olefins. These can be separated from the dewaxer effluent ahead of the hydrofinisher by conventional means, e.g., distillation. Second, suitable olefins may be added to the final stabilization reaction zone. Suitable olefins are characterized by the moiety:

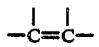

in which the dangling valences are attached to hydrogen, or alkyl, aryl, aralkyl, alkaryl or other alkenyl, said groups containing at least 3 carbon atoms, and preferably from 3 to about 20 carbon atoms. Olefins such as propylene, butene, hexene, decene, octadecene, butadiene, styrene, phenyl propylene, propylene and other polymers, such as propylene tetramer, and the like are suitable. The olefin can also be a mixture of olefins. Isobutylene is particularly effective either alone or in admixture with other olefins.

As used herein the term "a minor amount" refers to the amount of olefinic stabilizing agent relative to the amount of dewaxed effluent. Suitable minor amounts will range from as little as 0.2 weight percent of effluent to about 5.0 weight percent of effluent. The preferred range for the preferred stabilizing conditions detailed above is from about 0.4 weight percent of effluent to about 2.0 weight percent of effluent.

Unreacted hydrogen in the hydrocrackate stock need not be removed before performing the dewaxing or hydrofinishing step. If it is desirable to operate the dewaxing step at low pressures and after hydrogen is removed from the hydrocracked feedstock, pressure step up apparatus for the hydrofinishing step may be necessary.

In the case where olefins are to be generated internally, the preferred method of operation is to operate the dewaxing step at atmospheric pressures, or less than 35 bar (gauge). If olefins from an external source are to be used, high pressure operation, greater than 35 bar (gauge), is preferred. High pressure operation with hydrogen in the dewaxer tends to provide longer run lives (lower fouling) than low pressure operation.

In the acid stabilizing step, the preferred method of operation is to operate at atmospheric pressure, or less than 35 bar (gauge), and in the absence of hydrogen.

The present invention is exemplified below. The examples are intended to illustrate representative embodiments of the invention and results which have been obtained in laboratory analysis. Those familiar with the art will appreciate that other embodiments of the invention will provide equivalent results without departing from the essential features of the invention.

EXAMPLES

EXAMPLE 1

A hydrocracked medium neutral oil was dewaxed to −5° F, pour point over HZSM-5 (250 $SiO_2/Al_2O_3$)

bound with 35 wt % Catapal alumina and then hydrofinished over a 0.8 wt % Pd on $SiO_2$-$Al_2O_3$ catalyst. Both steps were carried out at 2300 psig, 1 LHSV, and 4500 SCF/bbl $H_2$. The temperature in the hydrofinishing section was held at 550° F. Inspections of the dewaxed and hydrofinished oil are given in Table I.

TABLE I

| Inspections of Dewaxed and Hydrofinished Medium Neutral Oil | |
|---|---|
| Gravity, °API | 31.7 |
| Flash Point, °F. | 455 |
| Pour Point, °F. | −5 |
| Viscosity, cS, | |
| 40° C. | 45.50 |
| 100° C. | 6.568 |
| Viscosity Index | 94 |
| Sulfur, ppm | 1.9 |
| Nitrogen, ppm | 0.3 |
| Distillation, LV %, °F. | |
| ST/5 | 733/780 |
| 10/30 | 788/809 |
| 50 | 825 |
| 70/90 | 850/894 |
| 95/EP | 925/949 |

Both the feed and hydrofinished product were tested for storage stability by placing 40 cc of each oil, in unstoppered cylindrical glass bottles of 1⅜ inches diameter and putting the bottles in a forced convection oven controlled at 250° F. The samples were examined once per day for floc. The test was ended when a moderate to heavy floc could be observed. Both the feed and product formed heavy floc in 3–4 days.

In order to exemplify the advantages of the present invention, a sample of the hydrofinished product was subjected to nonhydrogenative acid stabilization by mixing it with 1 wt % isobutene and treating it over an acidic montmorillonite clay (Filtrol Corporation F-24) at 0 psig, 400° F., and 0.4 LHSV. The product of the three-step process was tested for storage stability at 250° F. using the procedure described above. The oil lasted 9 days before forming floc, showing a marked improvement using the present invention.

In order to demonstrate that the improved stability achieved by including nonhydrogenative acid stabilization can be attributed to a reaction of the stabilizing agent with the floc forming species rather than to absorption of the floc forming species on the clay, the foregoing acid treatment was repeated without added isobutene, that is, in the absence of stabilizing agent. The 250° F. storage stability of the product was 3 days, about the same as the feed. Thus, it is essential to the present invention that the final stabilizing step be carried out in the presence of a minor amount of a stabilizing agent.

In order to demonstrate that the hydrofinishing step (second step) of the present process is essential, a feed similar to that used above was dewaxed to +5° F. pour point over HZSM-5, but not hydrofinished. Inspections of this dewaxed oil are given in Table II.

TABLE II

| Inspections of Dewaxed Medium Neutral Oil | |
|---|---|
| Gravity, °API | 34.0 |
| Pour Point, °F. | +5 |
| Viscosity, cS, | |
| 40° C. | 50.28 |
| 100° C. | 7.422 |
| Viscosity Index | 109 |
| Sulfur, ppm | 0.4 |

TABLE II-continued

| Inspections of Dewaxed Medium Neutral Oil | |
|---|---|
| Nitrogen, ppm | 0.1 |
| Distillation, LV %, °F. | |
| ST/5 | 724/782 |
| 10/30 | 803/847 |
| 50 | 879 |
| 70/90 | 913/972 |
| 95/EP | 998/1032 |

The oil was subjected to nonhydrogenative acid stabilization by mixing it with 1 wt% isobutene and treating it over an acid montmorillonite clay (Filtrol Corporation F-24) at 0 psig, 400° F., and 0.4 LHSV. The 250° F. storage stability for both the feed and the treated material was 3–4 days.

The improved results for the process of this invention are summarized in Table III below.

TABLE III

| | 250° F. Storage Stability | |
|---|---|---|
| Process | Storage Stability in Days | Stability Over Baseline (Days) |
| Feed (Baseline) | 3–4 | |
| Dewaxed + Hydrofinished | 3–4 | 0 |
| Dewaxed + Nonhydrogenative Acid Stabilized | 3–4 | 0 |
| Dewaxed + Hydrofinished + Nonhydrogenative Acid Stabilized | 9 | 6 |

Thus, it is evident that to achieve the advantages of the present invention, both stabilization steps, hydrofinishing and nonhydrogenative acid stabilizing are required.

EXAMPLE 2

A hydrocracked light neutral oil was dewaxed to +10° F. pour point and hydrofinished over the same catalyst system as used in Example 1. Inspections of the product are given in Table IV. The 250° F. storage stability was 2 days.

In order to exemplify the advantages of the present invention, a sample of the hydrofinished product was mixed with 1 wt % isobutene and treated over acidic montmorillonite clay at 0 psig, 400° F., and 0.4 LHSV. The 250° F. storage stability was 17–18 days.

In order to exemplify the role of the stabilizing agent, the above example was repeated, a first time but with only 0.1 wt % isobutene addition, and then a second time but without any isobutene addition. The 250° F. storage ability in both cases was 3–4 days.

TABLE IV

| Inspections of Dewaxed and Hydrofinished Light Neutral Oil | |
|---|---|
| Gravity, °API | 33.8 |
| Pour Point, °F. | +10 |
| Viscosity, cS, | |
| 40° C. | 20.71 |
| 100° C. | 4.109 |
| Viscosity Index | 96 |
| Sulfur, ppm | 4.8 |
| Nitrogen, ppm | 0.2 |
| Distillation, LV %, °F. | |
| ST/5 | 626/693 |
| 10/30 | 707/748 |
| 50 | 758 |
| 70/90 | 777/813 |
| 95/EP | 833/861 |

EXAMPLE 3

The hydrofinished product used in Example 2 was mixed with 5 LV % 1-pentene and treated over acidic montmorillonite clay at 0 psig, 300° F., and 0.4 LHSV. The 250° F. storage stability of the lube fraction was 5 days.

EXAMPLE 4

The hydrofinished product used in Examples 2 and 3 was mixed with 5 wt % propylene and treated over acidic montmorillonite clay at 0 psig, 300° F., and 0.4 LHSV. The 250° F. storage stability of the product was 13 days.

What is claimed is:

1. A process for improving the storage stability of a lubricating oil base stock prepared from a neutral oil hydrocrackate, comprising:

(a) contacting said neutral oil hydrocrackate with a catalyst comprising an intermediate pore size zeolite, said zeolite being in the hydrogen form, to produce a dewaxed effluent, (b) contacting said dewaxed effluent, with hydrogen in the presence of a hydrogenation catalyst under mild hydrogenation conditions to produce a hydrofinished effluent, and (c) contacting said hydrofinished effluent with a heterogeneous acidic catalyst in the presence of a minor amount of an olefinic stabilizing agent.

2. A process according to claim 1 wherein said intermediate pore size zeolite is selected from ZSM-5, ZSM-11, silicalite, and mixtures thereof.

3. A process according to claim 1 wherein said heterogeneous acidic catalyst comprises an acidic clay.

4. A process according to claim 3 wherein said acidic clay is selected from montmorillonite, attapulgite and mixtures thereof.

5. A process according to claim 1 wherein said heterogeneous acidic catalyst comprises a crystalline aluminosilicate and the temperature of step (b) is less than the temperature of step (a).

6. A process according to claim 1 wherein said feedstock is substantially free of diluent gases and wherein the pressure in step (a) is less than about 35 bar.

7. A process according to claim 1 wherein said feedstock contains diluent gases and wherein the pressure in step (a) is greater than about 35 bar.

8. A process according to claim 1 wherein said olefinic stabilizing agent is selected from the group consisting of $C_3$ to $C_{20}$ olefins.

9. A process according to claim 8 wherein said olefinic stabilizing agent is isobutylene.

10. A process according to claim 1 wherein the amount of said olefinic stabilizing agent ranges from about 0.2 percent by weight of said hydrofinished effluent to about 5.0 percent by weight of said hydrofinished effluent.

11. A process according to claim 10 wherein said amount ranges from about 0.4 percent by weight of said hydrofinished effluent to about 2.0 percent by weight of said hydrofinished effluent.

12. A process according to claim 11 wherein said amount is about 1.0 percent by weight of said hydrofinished effluent and said olefinic stabilizing agent is isobutylene.

* * * * *